US005149095A

United States Patent [19]

Kashimoto et al.

[11] Patent Number: 5,149,095

[45] Date of Patent: Sep. 22, 1992

[54] BALL CONVEYING GAME APPARATUS

[75] Inventors: Kiyoshi Kashimoto; Masanori Mizunuma, both of Tokyo, Japan

[73] Assignee: Tomy Company, Ltd., Tokyo, Japan

[21] Appl. No.: 789,684

[22] Filed: Nov. 8, 1991

[30] Foreign Application Priority Data

Nov. 30, 1990 [JP] Japan ..... 2-128070[U]

[51] Int. Cl.[5] ..... A63F 7/00

[52] U.S. Cl. ..... 273;121 B; 273/108; 273/118 A; 273/118 R; 273/119 A; 273/121 A

[58] Field of Search ..... 273/108, 109, 118 R, 273/119 R, 119 A, 120 R, 120 A, 121 R, 121 A, 121 B

[56] References Cited

U.S. PATENT DOCUMENTS

| | | | |
|---|---|---|---|
| 2,998,673 | 9/1961 | Rhodes | 273/120 R |
| 3,390,471 | 7/1968 | Godfrey | 273/118 R |
| 4,055,342 | 10/1977 | Matsumoto | 273/121 B X |
| 4,290,605 | 9/1981 | Matsumoto | 273/120 R X |
| 4,474,558 | 10/1984 | Quercetti | 273/118 R X |
| 4,840,375 | 6/1989 | Lawlor et al. | 273/121 B X |

*Primary Examiner*—Paul E. Shapiro
*Assistant Examiner*—Raleigh W. Chiu
*Attorney, Agent, or Firm*—Staas & Halsey

[57] ABSTRACT

A ball conveying game apparatus including a plurality of ball support portions provided on a vertical game board surface, a protrusible and retractable plunger provided at at least one of the ball support members, and a manual operating member such as a pressing member linked on an operational basis to the ball support member through a predetermined interlocking mechanism so that a ball can be transferred from one to another of the ball support members along a ball moving course by operating the manual operating member. The ball is conveyed from a starting point to a goal point by a plurality of choosable ball moving courses arranged in the ball moving course. Selection from among the choosable ball moving courses is made by operating the manual operating member. In playing the ball conveying game apparatus, therefore, a player is required to dexterously manipulate the manual operating member. Various ways of playing are possible.

20 Claims, 4 Drawing Sheets

BALL CONVEYING GAME APPARATUS

BACKGROUND OF THE INVENTION

1. Field of the Invention

This device relates to a ball conveying game apparatus, and more particularly to a ball conveying game apparatus in which a ball is manually moved up and/or down along a vertical game board surface by conveying it from a starting point to a goal point.

2. Description of the Related Art

A prior art ball conveying game apparatus designed for moving a ball upward along a vertical game board surface to convey the ball from a starting point to a goal point, is disclosed in Japanese Utility Model Laid-Open (KOKAI) No. 58-179175 (1983). The prior art ball conveying game apparatus is constructed such that a plurality of ball support portions are movably arranged on a vertical game board surface. Each of the ball support portions is linked on an operational basis to a manual operating member, such as a pressing member, through an interlocking mechanism so that a ball can be transferred from a preceding stage to a succeeding stage of the ball support portions along a ball moving course by operating the manual operating member. Thus, a ball is conveyed from a starting point to a goal point.

In the prior art ball conveying game apparatus, however, only one ball moving course is provided between the starting point and the goal point. Therefore, a player can only strive, for example, to obtain a shorter time to convey a predetermined number of balls from the starting point to the goal point. This does not provide a great deal of fun.

The present invention has been made in consideration of the above-mentioned problems.

SUMMARY OF THE INVENTION

An object of the present invention is to provide a ball conveying game apparatus in which a plurality of choices are arranged in a ball moving course to enable a player to have enough of a selection from among the choices arranged in the ball moving course.

Another object of the present invention is to provide a timed ball conveying game apparatus to see how many balls can reach a goal before time runs out.

The above-mentioned objects of the present invention is obtained by providing a ball conveying game apparatus comprising a plurality of ball support members provided on a vertical game board surface, a protrusible and retractable plunger provided at at least one of the ball support members, and a manual operating member such as a pressing member linked on an operational basis to the ball support member through a predetermined interlocking mechanism so that a ball can be transferred from one ball support member to another ball support member along a ball moving course by operating the manual operating member. The ball can thus be conveyed from a starting point to a goal point by choosing anyone of a plurality of ball moving courses by operating the manual operating member.

The above object, together with other objects and advantages which will be subsequently apparent, reside in the details of construction and operation as more fully hereinafter described and claimed, reference being had to the accompanying drawings forming a part hereof, wherein like reference numerals refer to like parts throughout.

DESCRIPTION OF THE PREFERRED EMBODIMENTS

According to the present invention, a plurality of choosable ball moving courses are arranged in a ball conveying course. Selection from among the choosable ball moving courses is made by operating a manual operating member. A player is required to manipulate the manual operating member delicately and deliberately. Various types of operation are possible.

A working example of the ball conveying game apparatus according to the present invention will be explained with reference to the drawings.

Figure 1:
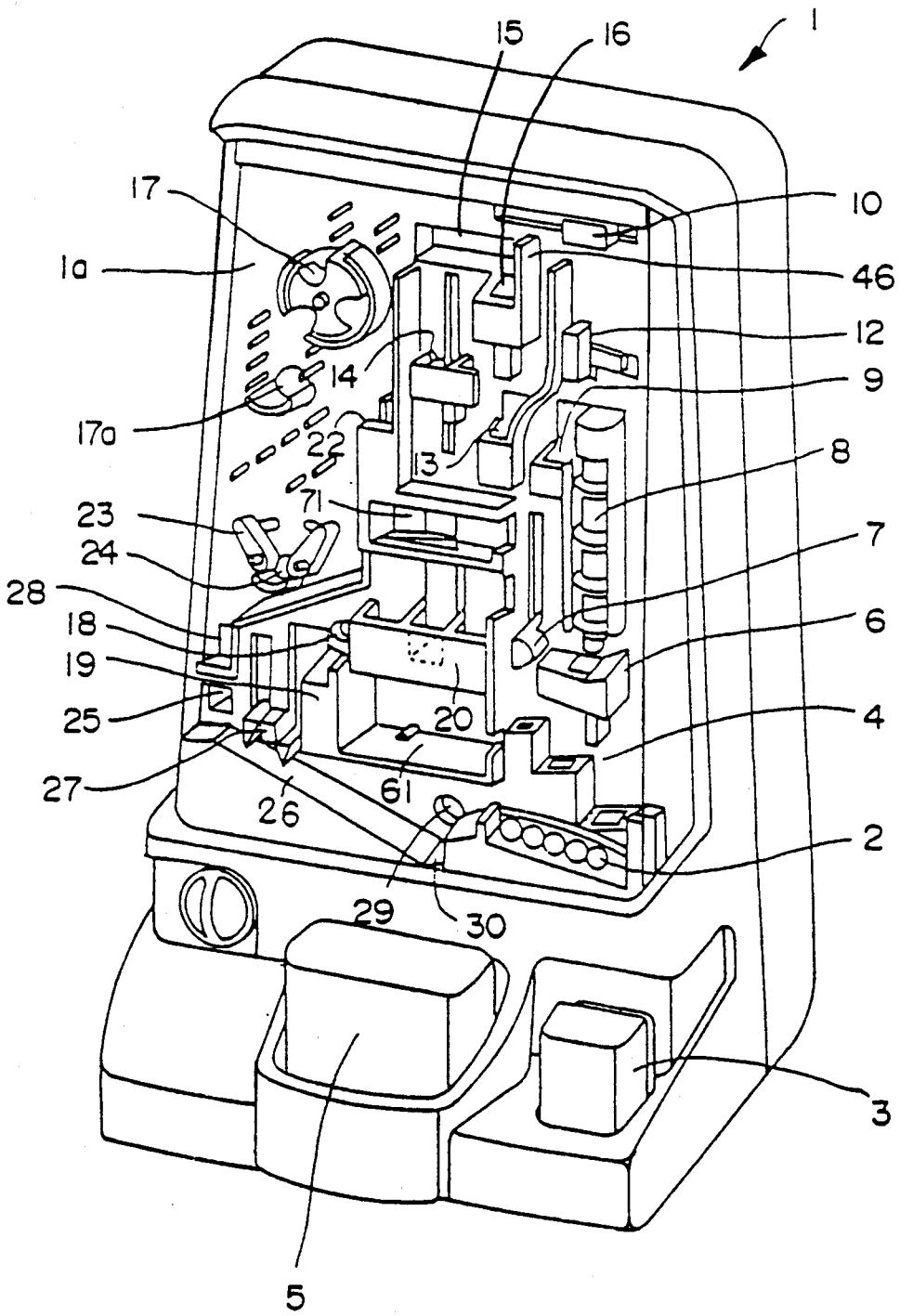
FIG. 1 is a perspective view of a ball conveying game apparatus according to the present invention.
Figure 2:
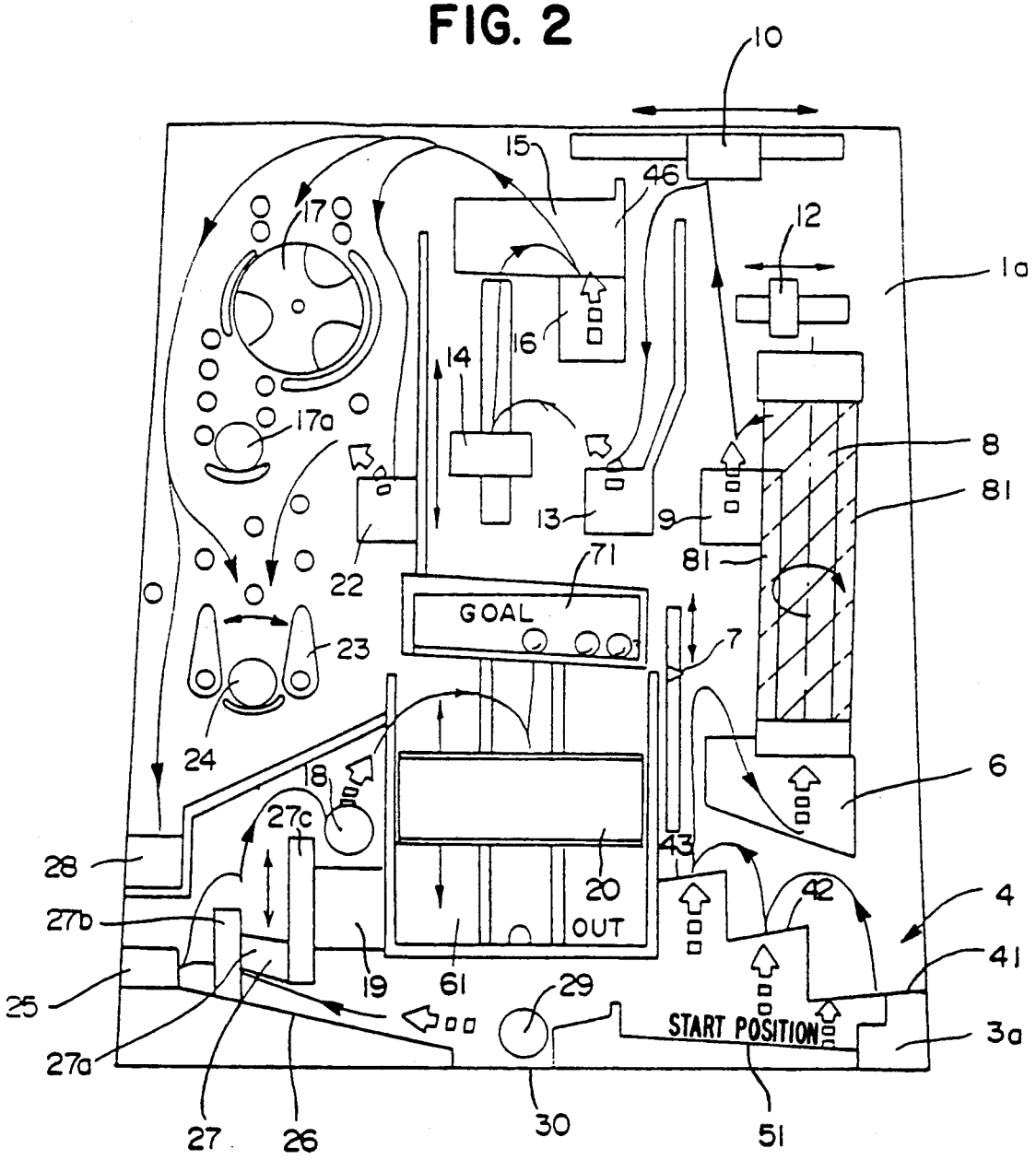
FIG. 2 is a front view of a game board surface of the ball conveying game apparatus in FIG. 1.
Figure 3:
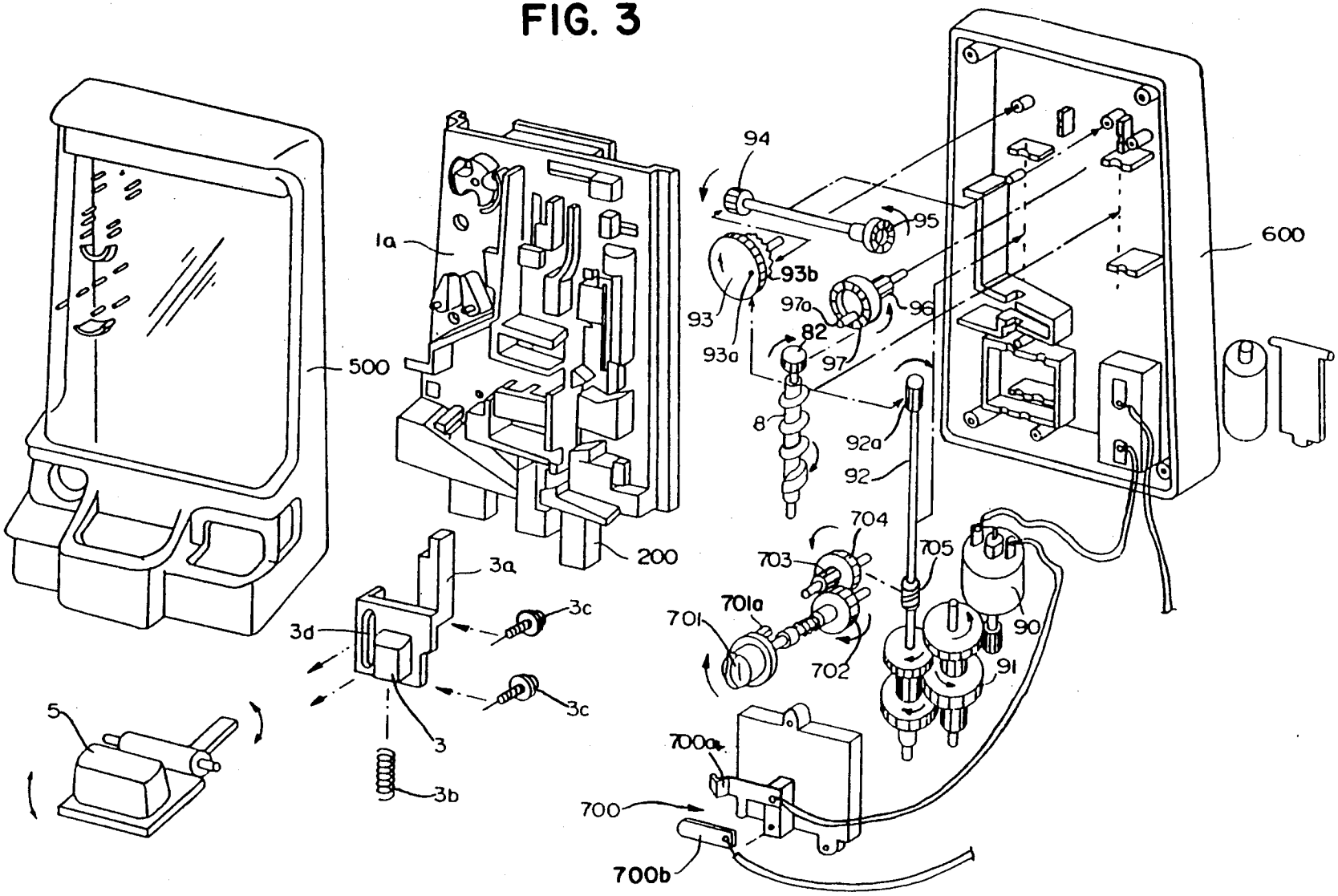
FIG. 3 is an exploded perspective view of the ball conveying game apparatus in FIG. 1.

In the ball conveying game apparatus 1 in FIG. 1, five steel balls 2 are reserved at a starting point at the start of the game. The five balls 2 are placed one at a time on a ball support portion 41 at a lower step of a flight of stairs 4 by a single pressing operation of a pressing member 3 provided at a front portion of the ball conveying game apparatus 1. That is, as shown in FIG. 2, the starting point lies on a slope 51, at the bottom of which is located a ball thrusting-up portion 3*a* formed in one body with the pressing member 3 and having a channel-shaped top. That is, two parallel sides are raised compared with a middle portion thereby forming a channel. The side closer to the side of the game apparatus is higher than the side adjacent the slope 51. The ball thrusting-up portion 3*a* is normally protruded above the surface of the slope 51 because of the pressing member 3 being urged upward by a spring 3*b* (FIG. 3). In FIG. 3, a screw 3*c* is fitted in a slot 3*d* formed in the pressing member 3, to guide upward and downward movements of the pressing member 3. When the pressing member 3 is pressed, the channel-shaped portion becomes substantially flush with the surface of the slope 51 so that the ball 2 is placed onto the channel-shaped portion by gravity. When the depression on the pressing member 3 is released the ball 2 rests on the channel-shaped portion and the pressing member 3 is returned to its original position by the restoring force of the spring 3*b*. Then, the channel-shaped portion becomes substantially flush with the ball support portion 41 at the lower step of the stair 4 and the ball 2 is transferred onto the ball support portion 41 at the lower step of the stairs 4. The channel-shaped portion is slanted appropriately to smooth the transfer of the ball 2 to the ball support 41.

Upon each operation of the pressing member 5, the ball 2 resting on the ball support portion 41 at the lower step of the stairs 4 is then sent to a ball support portion 42 at an intermediate step and then to a ball support portion 43 at an upper step. That is, at the ball support portion 41 at the lower step of the stairs 4 and the ball support portion 42 at the intermediate step, plungers 41*a* and 42*b* (FIG. 4) are respectively provided which protrude and retract relative to an upper surface of the relevant ball support portion. The plungers 41*a* and 42*a* are annexed to a first slider 200 which is disposed on the back side of the game board surface 1*a* and which moves up and down by a lever when the pressing member 5 is operated. When the pressing member 5 is pressed, the plungers 41*a* and 42*a* protrude from the ball support portion 41 at the lower step and from the ball support portion 42 at the intermediate step, respectively, to send the ball 2 to the ball support portion 43 at the upper step. In order to smooth such a transfer of the ball 2, the plungers 41*a* and 42*a* are provided with an appropriate slope.

Figure 4:
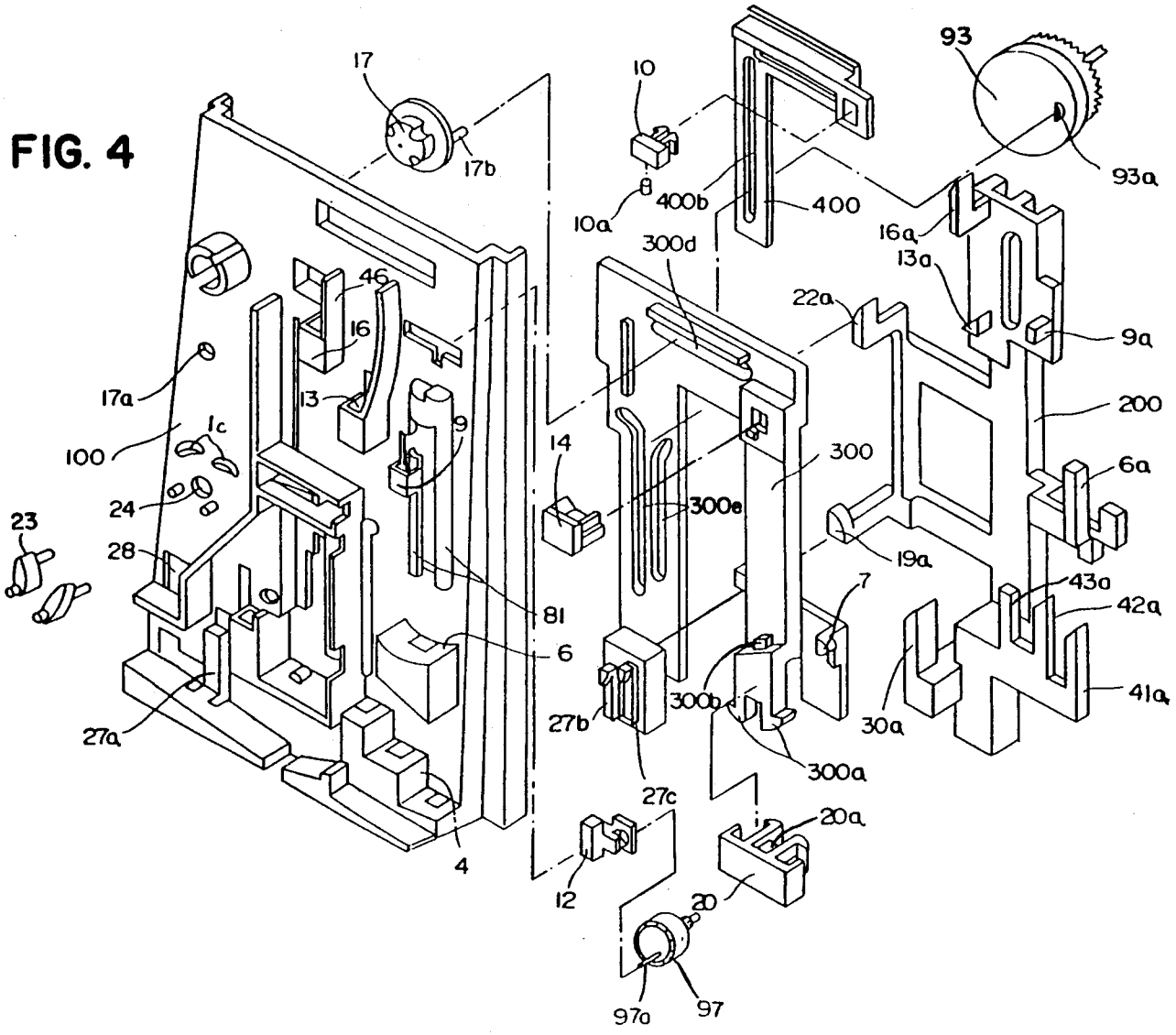
FIG. 4 is an exploded perspective view of the game board surface and various slider members disposed on the back side thereof.

The ball 2 moves up to the ball support portion 43 at the upper step of the stairs 4 and is sent to a ball support portion 6 by again pressing the pressing member 5. That is, the ball support portion 43 is provided with a plunger 43*a* capable of protruding and retracting relative to an upper surface of the ball support portion 43. The plunger 43*a* is annexed to the aforementioned first slider 200, as shown in FIG. 4. When the pressing member 5 is pressed, the plunger 43*a* protrudes from the ball support portion 43 at the upper step to send the ball 2 to the ball support portion 6. At this time, however, an obstacle member 7, disposed above the ball support portion 43, moves up and down to block the moving ball 2 to the ball support portion 6 or to control the direction of the ball 2. In other words, the ball conveying game apparatus 1 is so designed that, by hurling the ball 2 at the obstacle member 7 in a well-timed manner, the direction of the ball 2 is controlled and the ball 2 lands on the ball support portion 6. The obstacle member 7 is annexed to a second slider 300 disposed on the back side of the game board surface 1*a*. A drive mechanism which drives the obstacle member 7 will be described later.

The ball 2 on the ball support portion 6 is then sent to a ball portion 8 by again pressing the pressing member 5. A plunger 6*a* is provided at the ball support portion 6. The plunger 6*a* protrudes and retracts relative to an upper surface of the ball support portion 6. The plunger 6*a* is annexed to the aforementioned first slider 200, as shown in FIG. 4. When the pressing member 5 is pressed, the plunger 6*a* protrudes from the ball support portion 6 to send the ball 2 to the next ball support portion 8.

The ball support portion 8 is a ball conveying portion having a spiral groove. The ball support portion 8 is enclosed by covers 81 on both lateral sides thereof, as shown in FIG. 2. The ball support portion 8 is rotated in a direction to guide the ball 2 upward when the ball 2 is held in the spiral groove. The ball 2 sent from the ball support portion 6 is trapped in the spiral groove when a starting end of the spiral groove is located just above the ball support portion 8. At the ball support portion 6, therefore, it is necessary for the ball 2 to be sent when the starting end of the spiral groove is located just above the ball support portion 8. The ball 2 caught by the ball support portion 8 is maintained in place by the left and right covers 81 and a transparent front cover. An upper end portion of the cover 81 on the left-hand side (as shown in FIG. 1) of the ball support portion 8 is cut away so that when the ball 2 is carried to an upper portion of the ball support portion 8, the ball 2 falls through the cut portion onto a ball support portion 9.

The ball 2 resting on the ball support portion 9 is sent to a ball support portion 10 by pressing the pressing member 5. That is, at the ball support portion 9, a plunger 9*a* is provided which protrudes and retracts relative to an upper surface of the ball support portion 9. The plunger 9*a* is annexed to the aforementioned first slider 200, as shown in FIG. 4. When the pressing member 5 is pressed, the plunger 9*a* protrudes from the ball support portion 9 to send the ball 2 to the next ball support portion 10. At this time, however, an obstacle member 12, which is disposed on the upper side of the ball support portion 9 and moves right and left, obstructs the passage of the ball 2 to the ball support portion 10. Therefore, a technique for transferring the ball 2 to the ball support portion 10 by clearing the obstacle member 12 is required. A mounting construction and a drive mechanism for the obstacle member 12 will be described later.

The ball support portion 10 includes a magnet 10*a* to hold the steel ball 2 by magnetic attraction. The ball support portion 10 is engaged with a third slider 400 on the back side of the game board surface 1*a* and reciprocates left and right above the obstacle member 12. The ball 2 held by the ball support portion 10 is disengaged from the support portion 10 by a riser piece 46 and is sent to a ball support portion 13. A drive mechanism for the ball support portion 10 will be described later.

The ball 2 resting on the ball support portion 13 is sent to a ball support portion 14 by pressing the pressing member 5. The ball support portion 13 is provided with a plunger 13*a* capable of protruding and retracting relative to an upper surface of the ball support portion 13. The plunger 13*a* is annexed to the aforementioned first slider 200, as shown in FIG. 4. When the pressing member 5 is pressed, the plunger 13*a* protrudes from the ball support portion 13 and sends the ball 2 to the ball support portion 14. The plunger 13*a* has a slanted top surface so that the ball 2 flipped by the plunger 13*a* obliquely flies to the left side and, when well-timed, lands on the ball support portion 14 which reciprocates up and down. When the ball 2 is not timed to land on the ball support portion 14 due to a weak force applied to the pressing member 5, the ball 2 falls back to the ball support portion 6 or stairs 4.

The ball support portion 14 is constructed as a movable ball support portion. That is, the ball support portion 14 is engaged with the second slider 300, as shown in FIG. 4, so that it can be moved up and down by a motor drive. The ball support portion 14 includes a surface for supporting the ball 2 which is sloped in the back so that the ball support portion 14 releases the ball 2 when it reaches a recessed ball support portion 15 formed in an uppermost portion of the game board 1*a*. The recessed ball support portion 15 is also slightly slanted in a direction toward the right side of the game board 1*a*. The released ball 2 is guided by the recessed ball support portion 15 into the ball support portion 16.

The ball support portion 16 has an angled surface. The ball 2 seated on the ball support portion 16 is flipped obliquely to the left side of the game board 1*a* by pressing the pressing member 5. The ball 2 flies toward a plurality of ball support portions provided on the left-hand side (as viewed in FIGS. 1 and 2) of the game board 1*a*. That is, the ball support portion 16 is provided with a plunger 16*a* capable of protruding and retracting relative to an upper surface of the ball support portion 16. The plunger 16*a* is annexed to the aforementioned first slider 200, as shown in FIG. 4. When the pressing member 5 is pressed, the plunger 16*a* protrudes from the ball support portion 16 to send the ball 2 toward the next ball support portions.

A first one of the ball support portions which is next to the ball support portion 16 is a ball support portion 17. The ball support portion 17 includes a pinwheel which is rotated clockwise (as viewed in FIG. 2) by a motor drive. The ball 2 entering a recessed portion of the pinwheel 17 is led spontaneously into a hole 17*a* provided on the lower side of the pinwheel 17. The ball 2 then passes through the back side of the game board surface 1*a*, and emerges at a front side through a hole 18, and is seated on a ball support portion 19.

The ball 2 resting on the ball support portion 19 is sent to a ball support portion 20 by pressing the pressing member 5. The ball support portion 19 is provided with a plunger 19*a* capable of protruding and retracting relative to an upper surface of the ball support portion 19. The plunger 19*a* is annexed to the aforementioned first slider 200, as shown in FIG. 4. When the pressing member 5 is pressed, the plunger 19*a* protrudes from the ball support portion 19 to send the ball 2 to the next ball support portion 20.

The ball support portion 20 is partitioned into three spaces, only the middle space is closed at the bottom to be able to hold the ball 2 therein. When the ball enters the other spaces located on either side of the middle space, the ball 2 falls into an out ball room 61.

As shown in FIG. 4, the ball support portion 20 is fitted to the second slider 300 astride claws 300*a* of the second slider 300. However, the ball support portion 20 moves vertically relative to the second slider 300 and can be stopped at an arbitrary position within the range of vertical movement by its own elasticity. A bottom 20*a* provided for in the middle space in the ball support portion 20 is sloped toward the back side of the game board surface 1*a*, and is designed to be substantially flush with a projected portion 300*b* annexed to the second slider 300 when the ball support portion 20 is moved upward relative to the slider 300. The ball 2 rolls into the projected portion 300*b* and is inserted upward into a goal room 71. This is considered a goal. That is, when the slider 300 is lowered to bring the ball support portion 20 into collision with the bottom of the out ball room 61 and render the bottom 20*a* of the middle space in the ball support portion 20 flush with the above-mentioned projected portion 300*b*, the ball 2 is trapped on the bottom 20*a*. The ball 2 then rolls from the bottom 20*a* onto the projected portion 300*b*. The second slider 300 continues moving upward, and the ball support portion 20 collides against a top plate of the out ball room 61. Thereafter, only the second slider 300 moves upward, the projected portion 300*b* provided on the second slider 300 is brought into the goal room 71, and the ball 2 rolls to a predetermined position in the room. In order to smooth such a transfer process of the ball 2, the bottom 20*a* of the ball support portion 20, the tip of the projected portion 300*b* and a floor of the goal room 71 are provided with predetermined gradients.

A second ball support portion 22 is provided as another one of the ball support portions next to the ball support portion 16. The ball support portion 22 has an angled top surface. The ball 2 lands on the ball support portion 22 when it does not make it into the ball support portion 17. The ball 2 seated on the ball support portion 22 is expelled by pressing the pressing member 5 and aiming at the next ball support portion 23. That is, the ball support portion 22 is provided with a plunger 22*a* capable of protruding and retracting relative to the ball support portion 22. The plunger 22*a* is annexed to the aforementioned first slider 200, as shown in FIG. 4. When the pressing member 5 is pressed, the plunger 22*a* protrudes from the ball support portion 22 to send the ball 2 toward the ball support portion 23 or the like.

Less frequently, the ball 2 may be trapped directly in the ball support portion 23 without first falling onto the ball support portion 22.

The ball support portion 23 is a "tulip", which opens and closes by a motor drive. The ball 2 entering the tulip 23 is led spontaneously into a hole 24 on a lower portion of the tulip 23, then passes through the back side of the game board surface 1*a*, and emerges through a hole 25 and onto a slope 26. Pins 23*a* provided at eccentric positions with respect to oscillating shafts on the back of petal pieces of the tulip are engaged in cam holes 300*e* in the second slider 300 disposed on the back side of the game board surface 1*a*, through crescent holes 1*c* formed in the game board surface 1*a*. The cam holes 300*e* are spaced further apart from each other at an upper portion than a lower portion so that the tulip 28 is opened only when the slider 300 is lowered.

The ball 2 emerging onto the slope 26 rolls down the slope 26 and is spontaneously trapped in a ball support portion 27. The surface of the slope 26 is slanted in a direction toward the middle and bottom of the game board surface. In addition, the surface of the slope 26 is deep in a direction away from the front face of the game board surface 1*a*. The ball 2 can roll down either the deep portion of the slope 26 or a front portion of the slope 26. The ball support portion 27 is a composite of a central stationary portion 27*a* and movable pieces 27*b* and 27*c* on both sides of the central stationary portion 27*a*. That is, the ball support portion 27 includes the central stationary portion 27*a* formed in one body with the game board surface 1*a* and the movable pieces 27*b* and 27*c* formed in one body with the second slider 300. Of these elements, the movable piece 27*b* can catch only the ball 2 rolling down the deep portion of the slope 26. Therefore, while the movable pieces 27*b* and 27*c* of the ball support portion 27 move up and down by the motor drive, the ball 2 located on the movable piece 27*b* is sent to the central stationary portion 27*a* and then to the movable piece 27*c*. In addition, the ball 2 on the movable piece 27*c* is sent to the ball support portion 19 by an upward movement of the movable piece 27*c*. The subsequent transfer process of the ball 2, after arrival at the ball support portion 19, has been explained above. In order to smooth such a transfer process of the ball 2, the stationary portion 27*a* and the movable pieces 27*b* and 27*c* are provided with predetermined gradients.

When the ball 2 rolls down the slope 26 and is not trapped in the aforementioned ball support portion 27, it rolls into a ball support portion 30. Also, when the ball 2 is flipped from the ball support portion 16 and enters the hole 28, it passes through the hole 28 to the back side of the game board surface 1*a* and exists through a hole 29 to the ball support portion 30.

The ball 2 caught in the ball support portion 30 ascends the slope 26 by pressing the pressing member 5. That is, the ball support portion 30 is provided with a plunger 30*a* capable of protruding and retracting relative to an upper surface of the ball support portion 30. The plunger 30*a* is annexed to the aforementioned first slider 200, as shown in FIG. 4. When the pressing member 5 is pressed, the plunger 30*a* causes the ball 2*a* to go up the slope 26. When the ball 2 goes up the slope 26, however, the movable pieces 27*b* and 27*c* of the ball support portion 27 obstruct the passage of the ball 2. Therefore, the ball 2 is returned to the ball support portion 30 unless it is well timed to pass under the movable pieces 27*b* and 27*c*. When the ball 2 passes under the movable pieces 27*b* and 27*c* in a well-timed manner, it is treated in the same way as a ball 2 coming out of the hole 25 onto the slope 26.

Various mechanisms disposed on the back side of the game board surface 1*a* will now be explained.

The game board surface 1*a* is disposed in a housing comprising a front frame 500 and a rear frame 600. On the back side of the game board surface 1*a* the aforementioned first slider 200, second slider 300 and third slider 400 are disposed.

The first slider 200 is reciprocated up and down by manual operation of the pressing member 5, as described above. The plurality of plungers are provided in one body as part of the first slider 200 as above-mentioned.

The second slider 300 is reciprocated up and down by the motor drive, and the third slider 400 is reciprocated left and right by the motor drive. As shown in FIG. 3, a motor 90 is connected to a speed reduction mechanism 91. A pinion 92*a* on a shaft 92 for securely supporting a final-stage gear of the speed reduction mechanism 91 is in mesh with a spur gear 93. The spur gear 93 is provided with a fitting hole 93*a* at an eccentric position with respect to the axis of rotation thereof, as shown in FIG. 4. Into the fitting hole 93*a*, an eccentric pin 17*b* (having an eccentricity equal to that of the fitting hole 93*a*), provided on the back side of the pinwheel 17, is fitted via a laterally elongated slot 300*d* formed in the slider 300 and a vertically elongated slot 400*b* formed in the slider 400. Appropriate guide means (not shown) are provided so that the slider 300 can be moved only vertically whereas the slider 400 can be moved only horizontally. With the spur gear 93 rotated by the motor drive, the pinwheel 17 is rotated and, concurrently, the slider 300 is reciprocated up and down, and the slider 400 is reciprocated left and right.

A rotating power of the spur gear 93 is transmitted through gears 93*b*, 94, 95, 96 and 97 (FIG. 3) to a gear 82 attached to a shaft of the ball support portion 8. With this arrangement, the ball support portion 8 is rotated.

Furthermore, an eccentric pin 97*a* is projected from the inside of the gear 97 and is fitted in a slot 20*a* formed in the obstacle member 12 (FIG. 4). With this arrangement, the obstacle member 12 is reciprocated left and right.

Next, a mechanism for operating the motor 90 and a timer mechanism will be explained.

A battery 99 is inserted in the rear frame 600 of the game device. A cover 99*a* encloses the battery in the rear frame so it cannot fall out. The motor 90 is connected to the battery 99 and is operated through a leaf switch 700 (FIG. 3). The leaf switch 700 comprises switch elements 700*a* and 700*b*. The switch element 700*b* disposed on the back side of the switch element 700*a* is normally pressed so that it is separated from the switch element 700*a* by a protrusion 701*a* on the back side of a knob 701, whereby the motor 90 is in an OFF state. With the knob 701 rotated, the protrusion 701*a* is separated from the switch element 700*b* so that the switch element 700*b* contacts the back of the switch element 700*a* under an elastic returning force thereof, whereby the motor 90 is turned ON. Since a shaft of the knob 701 is linked through gears 702, 703, 704 and 705 to the speed reduction mechanism 91, however, the knob 701 again separates the switch elements 700*a* and 700*b* from each other upon returning to an original position thereof by rotating in a returning direction. The separation of the switch elements 700*a* and 700*b* turns OFF the motor 90. A clutch mechanism is intermediately provided for the shaft of the knob 701. This provides a timing mechanism for turning the motor 90 ON and OFF.

According to the ball conveying game apparatus 1 of the present invention as set forth above, the following effects can be obtained. Because a plurality of ball moving courses are present in a ball moving course and selection from among the ball moving courses is made by operating a pressing member 5, manipulation of the pressing member 5 in a gentle or hard manner is required to play the ball conveying game apparatus. Additionally, various ways of playing are possible. Thus, the ball conveying game apparatus of the present invention is superior in engagement and challenge with respect to conventional ball conveying game apparatuses.

The foregoing is considered as illustrative only of the principles of the invention. Further, since numerous modifications and changes will readily occur to those skilled in the art, it is not desired to limit the invention to the exact construction and application shown and described, and accordingly, all suitable modifications and equivalents may be resorted to, falling within the scope of the invention and the appended claims and their equivalents.

What is claimed is:

1. A ball conveying game apparatus comprising:

a plurality of balls;

a vertical game board surface;

a plurality of ball support portions provided on said vertical game board surface;

at least one protrusible and retractable plunger provided at at least one of said plurality of ball support portions;

a manual operating member, operatively connected to said plurality of ball support portions, for transferring a ball from one of said ball support portions to another one of said ball support portions along a ball moving course, and conveying the ball from a starting point to a goal point; and a plurality of choosable ball moving courses arranged in said ball moving course, selection from among said choosable ball moving courses made by operating said manual operating member.

2. A ball conveying game apparatus according to claim 1, wherein said manual operating member comprises a pressing member connected to said ball support portions through an interlocking mechanism.

3. A ball conveying game apparatus according to claim 1, wherein said ball conveying game apparatus further comprises:

first, second and third slider means having said at least one protrusible and retractable plunger attached thereto, said first and second slider means moving in a vertical direction and said third slider means moving in a horizontal direction.

4. A ball conveying game apparatus according to claim 3, wherein said slider means move by a battery operated motor drive.

5. A ball conveying game apparatus according to claim 4, wherein a first one of said ball support portions comprises step means for receiving said balls and moving said balls forward toward said ball support portions.

6. A ball conveying game apparatus according to claim 5, wherein a second one of said ball support portions comprises spiral groove means for receiving one of said balls and forwarding said ball to a next one of said ball support portions.

7. A ball conveying game apparatus according to claim 6, further comprising obstacle means connected to said second slider means, said obstacle means moving in a horizontal direction.

8. A ball conveying game apparatus according to claim 7, wherein a third one of said ball support portions comprises a magnetic ball support portion capable of moving in a horizontal direction and connected to said third slider means.

9. A ball conveying game apparatus according to claim 7, wherein a fourth one of said ball support portions comprises an element having a sloping surface and capable of moving in a vertical direction, said fourth ball support portion connected to said second slider means.

10. A ball conveying game apparatus according to claim 9, wherein a fifth one of said ball support portions comprises a pinwheel having recessed portions for receiving the ball.

11. A ball conveying game apparatus according to claim 10, wherein a sixth one of said ball support portions comprises a tulip shaped element including two movable portions rotating about first pins attached to a front face of said vertical game board to open and close around a common point.

12. A ball conveying game apparatus according to claim 11, wherein said second slider means includes cam holes spaced wider from each other at an upper portion than at a lower portion, and wherein said tulip shaped element further comprises second pins, attached to an upper portion of said movable portions opposite said first pins, protruding into said vertical game board toward a back surface and inserted into said cam holes in said second slider means.

13. A ball conveying game apparatus according to claim 12, wherein a seventh one of said ball support portions comprises an element divided into three portions, a middle portion having a closed bottom which slopes toward the back of the game apparatus and capable of moving in a vertical direction.

14. A ball conveying game apparatus according to claim 13, wherein an eighth one of said ball support portions comprises plunger means for protruding and retracting relative to an upper surface of said ball support portion, said plunger means connected to said first slider means.

15. A ball conveying game apparatus according to claim 14, wherein said first slider means moves in a vertical direction by operating said manual operating member.

16. A ball conveying game apparatus according to claim 15, wherein said second slider means is reciprocated in a vertical direction by said battery operated motor drive.

17. A ball conveying apparatus according to claim 16, wherein said third slider means is reciprocated in a horizontal direction by said battery operated motor drive.

18. A ball conveying game apparatus according to claim 17, further comprising timer means for turning on said battery operated motor drive and keeping it on for a predetermined period of time.

19. A ball conveying game apparatus according to claim 18, wherein said battery operated motor drive is connected to a speed reduction mechanism and leaf switch means for turning ON and OFF said motor.

20. A ball conveying game apparatus according to claim 19, wherein said first, second, and third slider means are operatively connected together.

* * * * *